United States Patent [19]

Mansell

[11] 4,449,452

[45] May 22, 1984

[54] RAPID PLATE MOUNTER

[75] Inventor: George B. Mansell, Cremorne, Australia

[73] Assignee: Rapid Packaging Services Pty. Ltd., New South Wales, Australia

[21] Appl. No.: 496,860

[22] Filed: May 23, 1983

[30] Foreign Application Priority Data

May 28, 1982 [AU] Australia ..... PF4202

[51] Int. Cl.[3] ..... B41F 27/00

[52] U.S. Cl. ..... 101/382 MV; 101/DIG. 12; 33/184.5

[58] Field of Search ... 101/382 R, 382 MV, DIG. 12, 101/1; 33/184.5, 286, 298

[56] References Cited

U.S. PATENT DOCUMENTS

| | | | |
|---|---|---|---|
| 2,984,910 | 5/1961 | La Cour | 101/DIG. 12 |
| 3,186,336 | 6/1965 | Kirby | 101/382 MV |
| 3,241,472 | 3/1966 | Robertson | 33/184.5 X |
| 3,361,060 | 1/1968 | Hoexter et al. | 101/DIG. 12 |
| 3,398,633 | 8/1968 | Ralvio | 33/184.5 X |
| 3,616,055 | 10/1971 | Mages | 101/DIG. 12 X |
| 4,033,259 | 7/1977 | Schuhmann | 101/DIG. 12 |
| 4,091,980 | 5/1978 | Gerber | 101/382 MV |
| 4,383,760 | 5/1983 | Deter et al. | 101/DIG. 12 |

FOREIGN PATENT DOCUMENTS

| | | | |
|---|---|---|---|
| 36206 | 9/1981 | European Pat. Off. | 101/DIG. 12 |
| 750014 | 6/1956 | United Kingdom | 101/DIG. 12 |
| 1018686 | 2/1966 | United Kingdom | 101/DIG. 12 |
| 2031341 | 4/1980 | United Kingdom | 101/DIG. 12 |

*Primary Examiner*—T. H. Eickholt

*Attorney, Agent, or Firm*—Ladas & Parry

[57] ABSTRACT

A printing plate mounting device (10) to receive a print cylinder (14) to aid in the application of a printing plate to the cylinder (14), the mounting device includes a support (12) for the cylinder (14) enabling vertical movement of the cylinder (14), and an optical magnifier (19) which is movably mounted so as to be movable in a direction generally normal to the longitudinal axis of the cylinder (14) so that the printing plate may be located at a predetermined location by alignment with the optical magnifier (19).

11 Claims, 4 Drawing Figures

RAPID PLATE MOUNTER

The present invention relates to a method and apparatus suitable for use in the optical alignment of photopolymer or other printing plates for mounting of same onto a print cylinder.

The mounting of photopolymer or other printing plates onto print cylinders for printing therefrom requires a high degree of accuracy in the alignment thereof so that the image is square and in register on the cylinder and consequently will print square and in register on the work. One common method to effect the alignment of the plates with respect to the print cylinder involves the drawing of a line around the print cylinder. This line is then aligned by eye with a longitudinal line along the length of the photopolymer or other print plate. This method is relatively accurate but can be extremely time consuming for the operator. This leads to undue delay between print runs and is costly with respect to the time lost between such runs.

Alternatively, there is commercially available a device to aid in the alignment of photopolymer or printing plates onto the print cylinder. The print cylinder is placed in fixed relationship to the device and the plate is layed upside down on a clear glass top. By means of a series of mirrors having lines thereon, the plate is aligned relative to the print cylinder. However, this device is also relatively time consuming and the required accuracy is not achieved. There is only a one-to-one relationship between the eye of the operator and the device assisting in the alignment which can lead to errors of up to 1 mm. These errors are unacceptable where accurate printing is required. This device is generally only acceptable for the alignment of printing plates with respect to one another rather than with respect to the print cylinder.

It is an object of the present invention to provide a device and method suitable for the accurate alignment of photopolymer or other printing plates with respect to the print cylinders which apparatus and method substantially overcomes or ameliorates the abovementioned disadvantages.

In one form the present invention provides a printing plate mounting device including, a frame;

a print cylinder support, mounted on the frame so as to locate the longitudinal axis of a print cylinder at a predetermined location;

a printing plate receiving surface located on the frame enabling transfer of a printing plate on the surface to said cylinder;

location means to aid in the location of the printing of the printing plate on said surface for correct alignment with said cylinder, said location means comprising an optical magnifier movably supported on said frame so as to be locatable at two spaced locations defining a line normal to said longitudinal axis, said magnifier having optical alignment markings so that a user can position the plate on said surface by alignment with said markings when at said locations.

In another form the invention provides a method for the accurate placement of a printing plate on a print cylinder said method comprising providing a frame on which is located a support means to support a print cylinder and to locate the longitudinal axis of said cylinder at a predetermined location, and a surface to receive said printing plate to enable transfer of said printing plate to said print cylinder; providing means to aid location of said printing plate relative to said cylinder said means comprising an optical magnifier movably supported by said frame so as to be locatable at two spaced locations defining a line normal to said longitudinal axis, said magnifier having optical alignment markings; placing a printing plate on said surface; aligning a preselected marking on said print plate with said optical alignment markings at one of said locations; aligning a second preselected marking on said print plate with said optical alignment markings at the second of said locations whilst maintaining the alignment of said first preselected marking; and placing the aligned print plate on and around said print cylinder.

Notwithstanding other forms which may fall within the broad scope of the present invention, a preferred form will now be described by way of example only and with reference to the accompanying drawings wherein.

Figure 1:
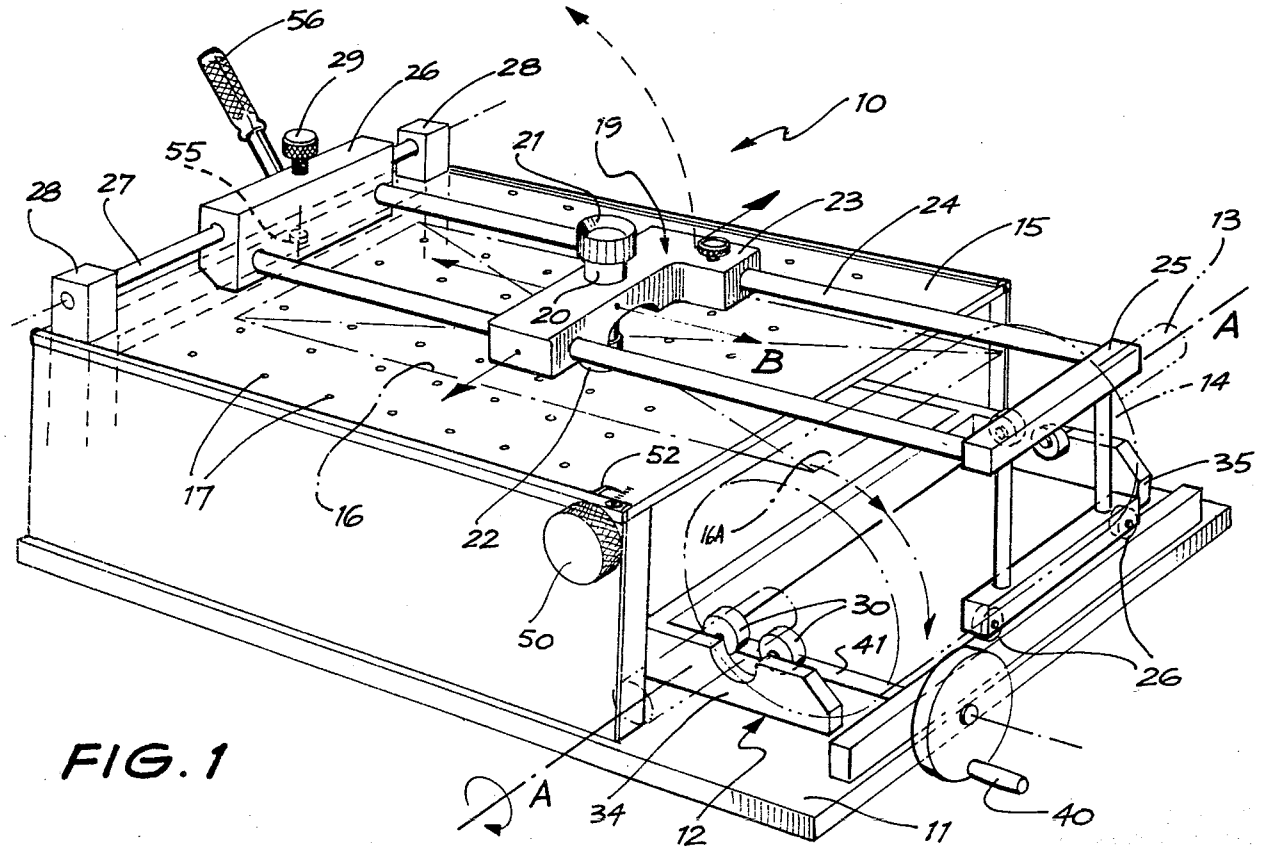
FIG. 1 is a schematic perspective of a print plate mounting device according to the present invention.
Figure 3:
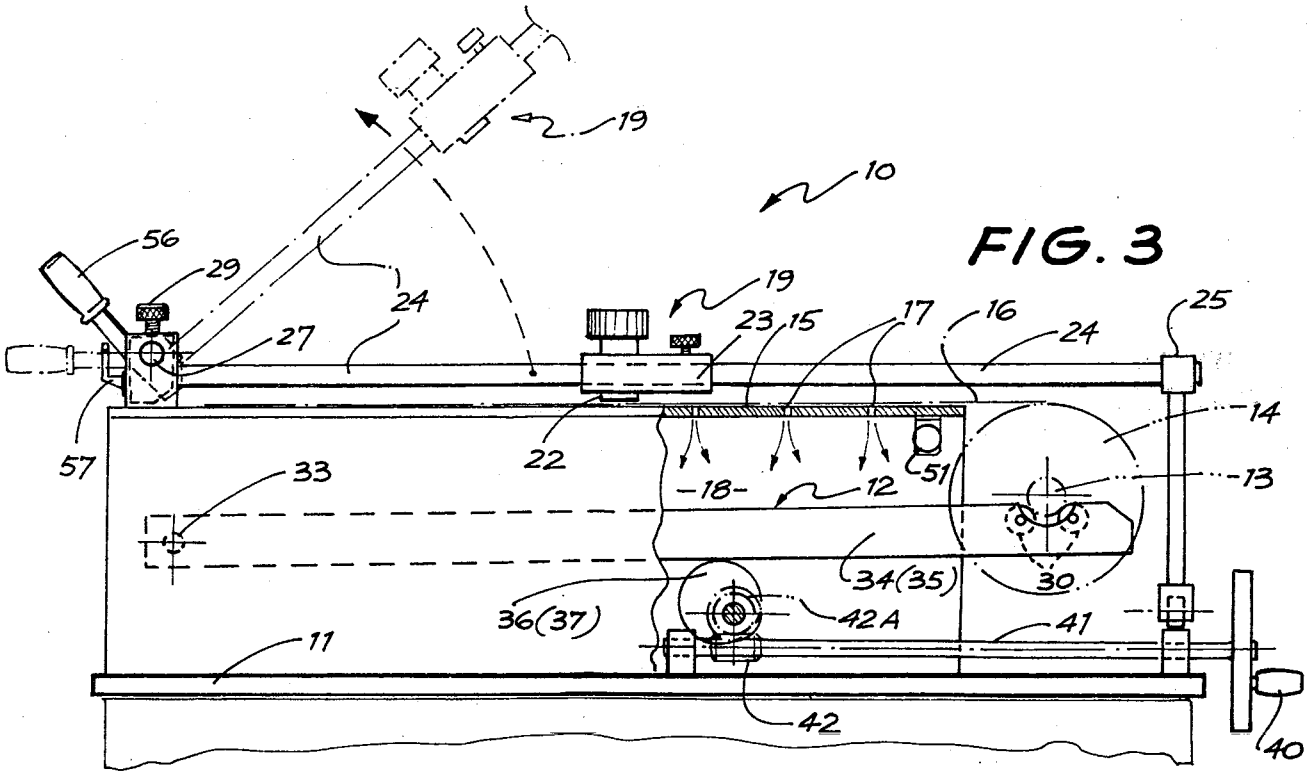
FIG. 3 is a schematic elevation of the device of FIG. 1.

Turning now to FIG. 1 there is shown a print plate mounting device 10 having a frame 11 upon which is mounted a print cylinder support 12 which supports the shaft 13 of a print cylinder 14. Support 12 is removably mounted on said frame 11 so that a variety of supports may be used depending on the size of the print cylinder. Frame 11 is provided with a printing plate receiving surface 15 which supports and receives a printing plate 16. Surface 15 is provided with a plurality of small apertures 17 so that printing plate 16 may be immovably located on surface 15 by a suction through said holes created by a vacuum forming means (not shown) located in the chamber 18 below said surface 15 as seen in FIG. 3.

Device 10 is provided with locating means 19 to aid in the location of the print plate 16 on surface 15 for accurate alignment of print plate 16 with respect to print cylinder 14. Locating means 19 comprises an optical magnifier 20 having an eye piece 21 and a base piece 22. The optical magnifier 20 is securely mounted in a block 23 which block is slidably mounted on rails 24 by means of instrument ball bushings (not shown).

Preferably base piece 22 is located at a relatively small distance from surface 15 so that alignment is more accurate.

Rails 24 are supported at both ends of frame 11. At the print cylinder end of said frame 11, rails 24 are mounted in a bracket 25 which is slidably mounted on frame 11 by means of rollers 26. At the other end of frame 11, rails 24 are mounted in a block 26 which is slidably mounted upon a supporting shaft 27 pivotally mounted on frame 11 in mounts 28. Block 26 can be locked to shaft 27 by means of screw lock 29 which, when in the locked position will frictionally engage shaft 27. When desired, block 26 can be released to slide along shaft 27 unscrewing screw 29 so that the locating means 19 can be moved transversely across the surface 15 to a desired location. As seen in FIG. 3, the locating means 19, rails 24 and bracket 25 can pivot upwards and away from surface 15 about shaft 26 for ease of placement of printing plate 16 on surface 15. Block 26 is provided with a lever 56 which engages catch 57 when the locating means 19 is pivotted upwardly away from surface 15, to lock the locating means 19 in the vertical position.

Figure 1A:
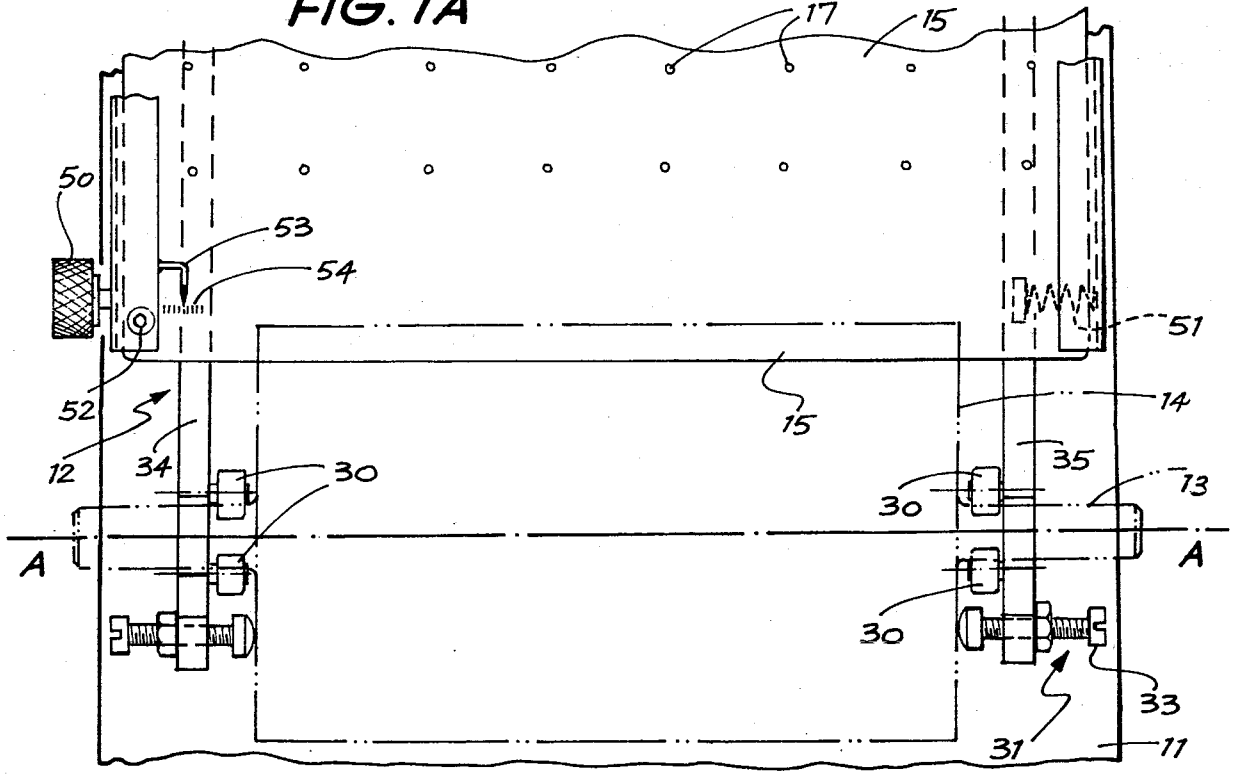
FIG. 1A is an enlarged plan view of the cylinder mounting means and means for fine lateral adjustment of the surface plate of the device of FIG. 1.

The shaft 13 of print cylinder 14 is supported on the print cylinder support 12 by means of rollers 30 which allow free rotation of the print cylinder shaft 13 on the support 12. Support 12 is also provided with a brake or stop means 31, on each side thereof as seen in FIG. 1A, which may be adjusted to frictionally engage the print cylinder 14 to prevent rotation thereof on rollers 30. Brake means 31 comprises screw 33, the head of which may engage cylinder 14 and retain it in frictional engagement with itself and with the stop 31 on the other side.

Print plate receiving surface 15 is movably supported by frame 11 so that it is movable relative to frame 11 for fine adjustment of the printing plate relative to the locating means.

At the print cylinder end of said frame 11 the edge of surface 15 abuts a return spring 51 which is under compression and is retained in engagement therewith by means of the shaft (not shown) of lateral adjustment screw 50. Surface 15 is provided with a scale 54, which moves relative to a pointer 53 provided on frame 11 when adjustment screw 50 is rotated. The surface 15 may be locked in position by locking screw 52.

At the other end of frame 11, surface 15 is pivotally mounted at pivot 55 as seen in FIG. 1.

Figure 2:
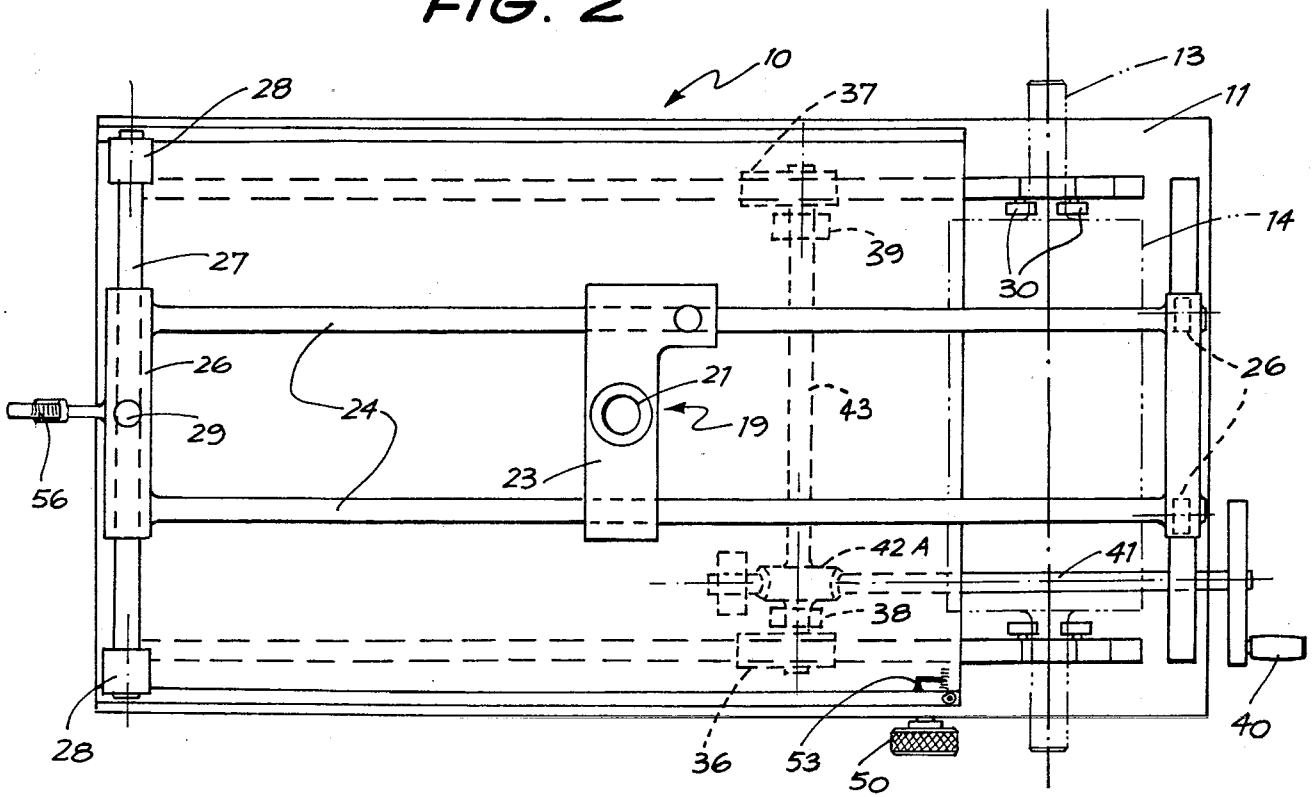
FIG. 2 is a schematic plan view of the device of FIG. 1.

Turning now to FIGS. 2 and 3 the print cylinder support 12 includes two arms 34 and 35 at either side thereof which are pivotally attached to frame 11 at 33, preferably by means of a shaft (not shown). Arms 34 and 35 are supported by cams 36 and 37 which cams are eccentrically mounted for rotation around a predetermined axis on mounting pivots 38 and 39. The height of the print cylinder support 12 and hence the print cylinder 14 can be adjusted by rotation of handle 40 which in turn rotates shaft 41 and worm gear 42 which engages complementary teeth (not shown) on worm wheel 42A to rotate shaft 43 which extends between cams 36 and 37 and rotates both cams simultaneously.

The optical magnifier 20 which is mounted in block 23 is preferably a loupe such as that manufactured by Peak Inc., of Japan. The magnification of ×7 has been found to be suitable. The eye piece 21 is preferably provided with focusing means. The magnifier 20 is provided with optical alignment markings such as cross hairs which in use are aligned with alignment markings such as registration marks which are usually present on the printing plates. To avoid or reduce parallax error, the eye piece is provided with a "mask" (not shown) which effectively reduces the diameter of the eye piece so that a standard alignment between the eye of the viewer and the cross hairs is achieved. The mask may be in the form of a washer.

Preferably, the printing plate receiving surface 15 is a translucent or transparent surface such as plexiglass, to allow the transmission of light therethrough. For ease of use, a light (not shown) is provided in the chamber 18 below surface 15 to illuminate the plate. Preferably, the surface 15 is also provided with one or more lines normal to the longitudinal axis AA of print cylinder 14. Such lines facilitate initial preliminary alignment of the print sheet normal to the longitudinal axis AA.

In use, initially the print cylinder bearing the adhesive for the print plate is placed in the print cylinder support 12 so that shaft 13 is on rollers 30. The print cylinder 14 is secured in the support 12 by means of adjustment of the brake or stop means 31. Print cylinder support 12 is adjusted to its lowest position by rotation of handle 40.

The locating means 19, rails 24 and bracket 25 are pivoted about shaft 26 to the vertical position, as shown in FIG. 2 by means of dotted lines, until lever 56 engages catch 57. The print plate is layed onto the surface 15. The leading edge 16A of the print plate 16 protrudes about 20 to 25 mm over the leading edge 15A of surface 15.

A rough alignment of print plate 16 is undertaken by means of an alignment of the registration mark or the like (not shown) of print plate 16 on the lines provided on surface 15 (not shown) normal to the axis AA. Location means 19 on rails 24 is lowered by releasing catch 57 and pivoting block 26 downwardly about shaft 27 as shown in FIG. 3. By longitudinal movement of block 23 along rails 24 and transverse movement of block 26 along shaft 27 alignment of the cross hairs in optical magnifier 20 with a registration mark or the like on print plate 16 is achieved. Of course, focusing of the eye piece 21 is undertaken at an appropriate time by the user. Preferably the registration mark closest to the far edge 16B of print plate 16 is aligned initially. When alignment is exact between the cross hairs of the optical magnifier 20 and the registration mark on print plate 16, print plate 16 is secured immovable to surface 15, preferably by means of suction through holes 17 provided by a vacuum forming means (not shown) provided in chamber 18.

Screw 29 is tightened to prevent movement of block 26 on shaft 27 so that transverse movement of the locating means 19 is no longer possible.

Block 23 is moved along rails 24 in direction B so that a second registration mark of print plate 16 is found. If alignment of print plate 16 with respect to longitudinal axis AA of print cylinder 14 is correct, the second registration mark on print plate 16 will line up exactly with the cross hairs of optical magnifier 20. If correction is required, the vacuum forming means is turned off to release plate 16 from surface 15 and adjustment of print plate 16 is undertaken. If only fine lateral adjustment is required surface 15 may be moved transversely, by means of screw 50 without releasing plate 16 from surface 15. When correct alignment of print plate 16 with respect to longitudinal axis AA of print cylinder 14 is achieved, exact alignment of the registration or preselected markings on print plate 16 at two locations thereon will be achieved. Preferably, the two or more registration marks on print plate 16 are spaced at a relatively significant distance from one another, as in this way accuracy is increased.

Subsequent to correct alignment, and while print plate 16 is immovably fixed to surface 15, the locating means 19 is moved about shaft 26 to the vertical position and print cylinder support 12 is raised by means of rotation of handle 36 as seen in FIG. 3.

At this stage, the upper surface of print cylinder 14 should generally abut the lower surface of print plate 16 which extends from the leading edge of surface 15A. Pressure is applied to the surface of print plate 16 so that about 10 mm of the lower surface of print plate 16 is in contact with print cylinder 14 upon which an adhesive has been applied. The shaft 13 of print cylinder 14 is rotated in the direction of arrow C whilst pressure is applied to the print plate 16 at the point of contact with the print cylinder 14.

In a preferred embodiment of the invention, not illustrated, a rubber clamping roller is provided pivotally mounted on said frame and adapted to abut print cylinder 14 in frictional engagement therewith. Rotation of the clamp roller handle will rotate the clamp roller and effect rotation of the print cylinder 14 so as to wind the print plate 16 thereon.

The print cylinder 14 is then lifted out of the support 12 and is ready to be placed in the printing machine.

It has been found that the device of the present invention is also suitable for use in the correct alignment of rubber printing plates, sometimes called stereos, which are used in a flexigraphic printing process. The stereos are produced from a black rubber-like substance and accordingly it would not be necessary to use back lighting of the surface 15. It is preferred that the optical magnifying means is also provided with a lighting means preferably in the retrical casing to facilitate alignment when using the device with steroes.

Although a preferred form of the invention has been described for horizontal placement it should be noted that the mounting device may be used in a vertical orientation. In this form the print cylinder support is adapted to lock the cylinders securely in position in the cradle. The vertical orientation is found to be more easily used when larger cylinders are used.

What I claim is:

1. A printing plate mounting device including, a frame;

a print cylinder support, mounted on the frame so as to locate the longitudinal axis of a print cylinder at a predetermined location;

a printing plate receiving surface located on the frame enabling transfer of a printing plate on the surface to said cylinder;

location means to aid in the location of the printing plate on said surface for correct alignment with said cylinder, said location means comprising an optical magnifier movably supported on said frame so as to be locatable at two spaced locations defining a line normal to said longitudinal axis, said magnifier having optical alignment markings so that a user can position the plate on said surface by alignment with said markings when at said locations.

2. The mounting device of claim 1 wherein said surface is planar and extends generally parallel to said longitudinal axis.

3. The mounting device of claim 1 wherein said location means includes an elongated sub-frame extending generally normally sway from said axis and being positioned above said surface, and said optical magnifier is supported on said sub-frame so as to be movable therealong in a direction generally normal to said axis.

4. The mounting device of claim 3 wherein said sub-frame is mounted on said frame at a position remote from said axis so that said sub-frame is pivotally movable about a pivot axis extending generally parallel to said longitudinal axis but spaced therefrom so that said sub-frame is movable from a position extending generally parallel and adjacent said surface to a position extending at an inclined angle away from said surface.

5. The mounting device of claim 4 wherein said sub-frame includes two generally parallel extending rods which extend generally radially outwardly from said pivot axis and upon which said optical magnifier is slidably mounted so as to be movable in a direction generally normal to said longitudinal axis.

6. The mounting device of claim 3, wherein said sub-frame is mounted on said frame so as to be movable in a direction generally parallel to said longitudinal axis.

7. The mounting device of claim 1 wherein said print cylinder support includes a position adjustment means enabling movement of said cylinder from a retracted position to a position having its circumferential surface tangential to a plane defined by said surface.

8. The mounting device of claim 7 wherein said cylinder support includes bearings which rotatably support said cylinder to enable rotation thereof about said longitudinal axis.

9. The mounting device of claim 7 wherein said adjustment means includes a lever pivotted at a position remote from said longitudinal axis enabling pivoting of said lever about an axis generally parallel to said longitudinal axis, with said lever being adapted at its other end to receive said cylinder.

10. The mounting device of claim 9 wherein said height adjustment means further includes rotatable cam means to cause pivoting of said lever to move said cylinder generally normal to said surface.

11. A method for the accurate placement of a printing plate on a print cylinder said method comprising providing a frame on which is located a support means to support a print cylinder and to locate the longitudinal axis of said cylinder at a predetermined location, and a surface to receive said printing plate to enable transfer of said printing plate to said print cylinder; providing means to aid location of said printing plate relative to said cylinder said means comprising an optical magnifier movably supported by said frame so as to be locatable at two spaced locations defining a line normal to said longitudinal axis, said magnifier having optical alignment markings; placing a printing plate on said surface; aligning a preselected marking on said print plate with said optical alignment markings at one of said locations; aligning a second preselected marking on said print plate with said optical alignment markings at the second of said locations whilst maintaining the alignment of said first preselected marking; and placing the aligned print plate on and around said print cylinder.

* * * * *